United States Patent [19]

Stauffer

[11] Patent Number: 4,890,591

[45] Date of Patent: Jan. 2, 1990

[54] ROTARY INTERNAL COMBUSTION ENGINE AND METHOD OF STARTING THE ENGINE

[76] Inventor: John E. Stauffer, 6 Pecksland Rd., Greenwich, Conn. 06830

[21] Appl. No.: 118,546

[22] Filed: Nov. 9, 1987

Related U.S. Application Data

[63] Continuation-in-part of Ser. No. 773,636, Sep. 9, 1985, abandoned.

[51] Int. Cl.[4] ..... F02B 53/00

[52] U.S. Cl. ..... 123/213; 123/245; 418/35

[58] Field of Search ..... 123/213, 245, 559; 418/35, 36

[56] References Cited

U.S. PATENT DOCUMENTS

| | | | |
|---|---|---|---|
| 951,197 | 3/1910 | O'Connor | 418/36 |
| 1,224,642 | 5/1917 | Holmes | 418/35 |
| 1,962,408 | 6/1934 | Powell | 418/36 |
| 2,302,254 | 11/1942 | Rhine | 123/213 X |
| 3,294,071 | 12/1966 | Turco | 418/35 |
| 3,329,132 | 7/1967 | Castelet | 123/213 X |
| 3,418,986 | 12/1968 | Scherenberg | 123/559.1 |

FOREIGN PATENT DOCUMENTS

| | | | |
|---|---|---|---|
| 920601 | 1/1947 | France | 418/35 |

*Primary Examiner*—Michael Koczo
*Attorney, Agent, or Firm*—Krass and Young

[57] ABSTRACT

A rotary internal combustion engine including a housing defining a combustion chamber; a first vane mounted for rotation in the combustion on a fixed axis; a second vane mounted for rotation in the combustion chamber on the fixed axis independently of the first vane; a separate ratchet mechanism respectively engaging the first and second vanes to preclude rotation of the vanes in one direction about the axis while allowing free rotation in the other direction; a converter mechanism, including an output shaft, drivingly connected to the vanes and operative to convert the rotation of the vanes into a unidirectional, constant speed rotation of the output shaft of the converter means; and a supercharger drivingly connected to the output shaft of the converter mechanism and operative to deliver a continuous charge under boost pressure to the input port of the combustion chamber to facilitate starting of the engine and preclude stalling of the engine under idling conditions.

11 Claims, 3 Drawing Sheets

ROTARY INTERNAL COMBUSTION ENGINE AND METHOD OF STARTING THE ENGINE

RELATED APPLICATION

This application is a continuation-in-part of U.S. patent application Ser. No. 773,636, filed Sept. 9, 1985.

TECHNICAL FIELD

This invention relates to drive assemblies, and more particularly to a drive assembly that is particularly suitable for use as a rotary internal combustion engine.

BACKGROUND OF THE INVENTION

A multitude of designs have been proposed for rotary internal combustion engines over the years and yet, despite the multiplicity of such rotary designs, and despite the obvious advantages of unidirectional movement inherent in the rotary design, the reciprocating variety of engine continues to account for the vast majority of internal combustion engines sold. This presumably is because the various rotary designs proposed have either been too complex to manufacture on a large scale, have been inefficient in operation, have required an inordinate amount of maintenance, or have had a relatively short product life.

This invention relates to a rotary internal combustion engine of the type in which two rotating pistons or vanes are connected to concentric shafts or hubs with the leading and following pistons rotating in a manner that allows the pistons to alternately approach and move away from each other to permit the intake of a combustible fuel mixture, its compression, ignition, expansion and exhaust. Prior art rotary internal combustion engines of this type have suffered from an inability to convert the somewhat promiscuous and seemingly random movement of the two pistons into a predictable, usable movement of an output shaft. Prior art attempts to provide a predictable or usable movement of the output shaft have involved the attempted use of a predetermined program to control the compression and expansion strokes wherein a fixed program of motion between the pistons is established by the use of cams, lobes, planetary gears, cranks, grooves, slots, rollers or other similar linkages. However, these prior art attempts to provide a predictable, usable movement of the output shaft by providing a predetermined fixed program of motion between the pistons have been unsuccessful since they have generated uncompensated stresses which have tended to literally tear the engine apart. They have also resulted in engine designs that are unduly complex, unduly expensive to manufacture, and which require an inordinate amount of maintenance.

SUMMARY OF THE INVENTION

This invention is directed to the provision of an improved rotary internal combustion engine of the rotary piston type.

More specifically, this invention is directed to the provision of a rotary internal combustion engine having improved provision for engine starting and improved provision for reliable engine operation under idle conditions.

The invention engine includes a housing; a first piston or vane mounted for rotation in the housing on a fixed axis; a second piston or vane mounted for rotation in the housing on the fixed axis independently of the first vane; control means precluding rotation of either vane in one direction about the axis while allowing free rotation in the other direction about the axis so that the vanes may rotate freely in the other direction and may simultaneously undergo relative rotation; converter means, including an output shaft, drivingly connected to the vanes and operative to convert the rotation of the vanes in such other direction as well as the relative rotation of the vanes into a unidirectional, steady speed rotation of the output shaft of the converter means; and means for delivering a charge to the housing under a boost pressure.

The rotary vanes are mounted on concentric shafts and the concentric shafts in turn are drivingly connected to separate elements of the converter means. The separate elements in the converter means operate to drive the output shaft of the converter means at a uniform, constant speed. The concentric shafts of the two rotary vanes are precluded from rotation in the opposite direction by ratchet means which respectively coact with each of the concentric shafts.

In one embodiment of the invention, the converter means comprises a differential gear assembly in which the concentric shafts, which are rotating in the same direction but at different speeds, are coupled to different pinions in the differential gear assembly and the pinions coact in known differential gear manner to rotate the output shaft of the differential gear assembly in a unidirectional, constant speed manner.

According to another embodiment of the invention, the converter means may comprise a pneumatic coupling which is comprised of vanes which move in the same pattern as the vanes of the engine.

According to a further embodiment, the converter means may comprise a hydraulic coupling, and according to a still further embodiment, the converter means may comprise a hydraulic differential coupling.

In each of the embodiments, and according to an important feature of the invention, a charge is continuously delivered to the housing under a boost pressure by the use of, for example, a supercharger driven by the output shaft of the engine. The charge under boost pressure facilitates starting of the engine by providing relative rotation between the vanes; optimizes engine power under steady state operation by increasing the charge delivered to the engine; and precludes stalling of the engine under idling conditions by ensuring that a charge is delivered under pressure between the vanes.

DETAILED DESCRIPTION OF THE PREFERRED EMBODIMENT

Figure 1:
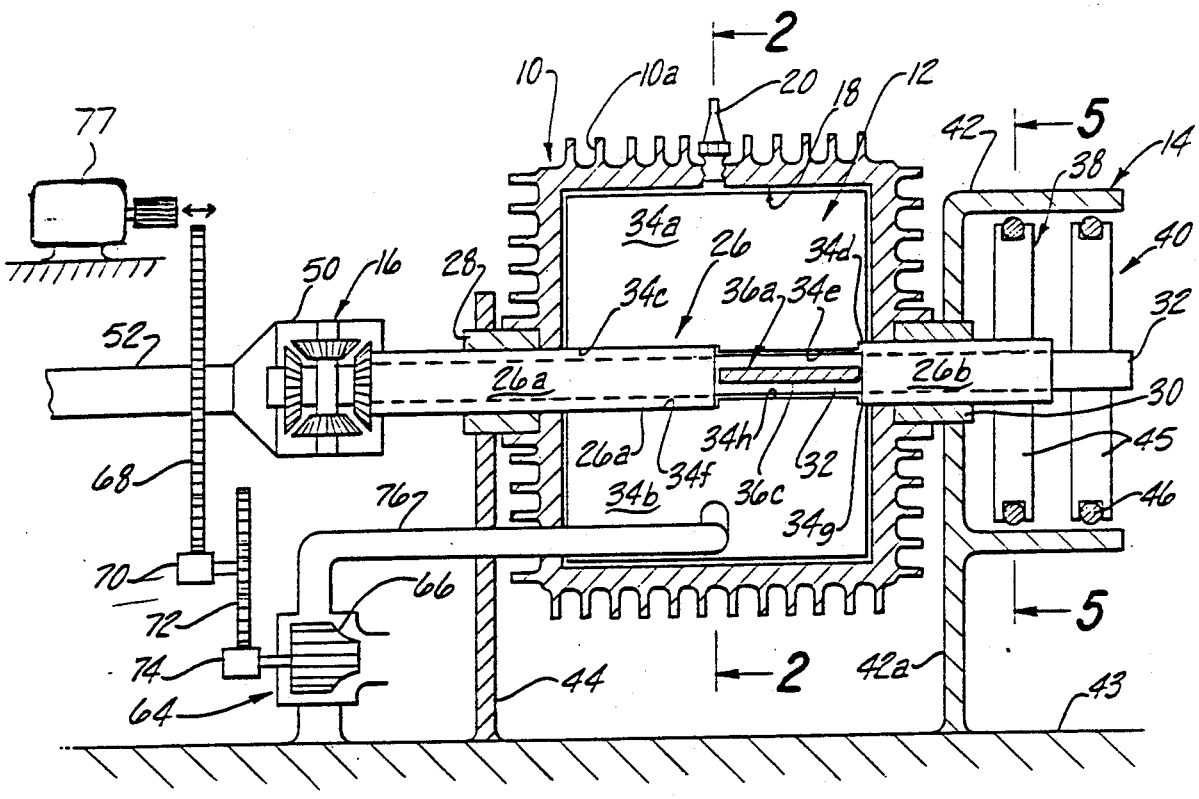
FIG. 1 is a schematic, longitudinal cross-sectional view of the invention engine.

The rotary internal combustion engine seen in schematically and in longitudinal cross section in FIG. 1, broadly considered, includes a housing 10; a rotary piston assembly 12; a ratchet assembly 14; and a converter mechanism 16.

Housing 10 is cylindrical and defines a cylindrical combustion chamber 18. A sparkplug or glow plug 20 is provided at a top dead center location in the housing and communicates with combustion chamber 18, and intake and exhaust ports 22 and 24 are provided adjacent the lower end of the housing generally opposite plug 20. For example, the intake and exhaust ports may be located on opposite sides of, and approximately twenty degrees from, the bottom dead center or six o'clock position on the housing. Fins 10*a* are provided for cooling housing Rotary piston assembly 12 is positioned within housing 10 and includes a first shaft or hub 26 including axially spaced separate portions 26*a* and 26*b;* a pair of bearings 28 and 30 positioned in opposite side walls of housing 10 and respectively journalling shaft portions 26*a* and 26*b;* a shaft or hub 32 concentric with shaft 26 and journalled within shaft 26; a first rotary vane or piston 34 secured to shaft portions 26*a* and 26*b*, and a second vane or piston 36 secured to shaft 32.

Vane 34 includes first and second portions 34*a* and 34*b*. Portion 34*a* is secured to shaft portion 26*a* along inner vane edge 34*c* and is secured to shaft portion 26*b* at 34*d* with an intermediate inner vane edge portion 34*e* closely but slideably interfacing with shaft 32. Vane portion 34*b* is secured to shaft portion 26*a* along inner vane edge 34*f* and is secured to shaft portion 26*b* at 34*g* with an intermediate vane edge portion 34*h* closely but slideably interfacing with shaft 32.

Vane 36 includes first and second portions 36*a* 36*b*. Vane portion 36*a* is secured to shaft 32 along inner vane edge 36*c* and closely but slideably interfaces with shaft portion 26*a* at 36*d* and with shaft portion 26*b* at 36*e*. Vane portion 36*b* is similarly mounted and disposed with respect to shaft 32 and shaft portions 26*a* and 36*b*. Vanes or pistons 34 and 36 are configured to fit as tightly as possible within the combustion chamber without actually touching the walls of the chamber as they rotate relative to the chamber. If desired, an internal lubricant or oil may be used to protect the edges of the pistons and the adjacent walls of the chamber although, with proper control of the fit between the pistons and the walls of the combustion chamber, an internal lubricant may not be necessary. As seen, the pistons have a generally wedge shaped configuration. Although other piston shapes may be used, the disclosed wedge shape is desirable because, as the pistons approach each other during their relative rotation within the combustion chamber, their faces move into a parallel relationship to minimize the danger of any protrusions on the faces of either piston coming into contact with the adjacent piston.

Figure 5:
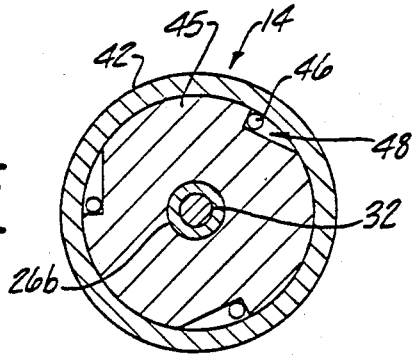
FIG. 5 is a transverse cross-sectional view taken on lines 5—5 of FIG. 1.

Ratchet assembly 14, as best seem in FIGS. 1 and 5, includes a pair of ratchet mechanisms 38 and 40 respectively associated with each of the concentric shafts 26 and 32. Ratchet mechanisms 38 and 40 are disposed side-by-side in axially spaced relation in a circular housing 42. Housing 42 includes an end wall 42*a* upstanding from a suitable support surface 43 and supporting bearing 30 and thereby one end of housing 10. The other end of housing 10 is supported by a support plate 44 upstanding from surface 43 and supporting bearing 28.

Each ratchet mechanism includes a circular ratchet body 45 secured to the respective shaft and a plurality of balls 46 respectively ensconced in a plurality of circumferentially spaced pockets 48 provided on the periphery of ratchet body 45. Ratchet body 45 and balls 46 coact in known manner with housing 42 to preclude counterclockwise rotation of the respective shaft as viewed in FIG. 5 while allowing free clockwise rotation of the respective shaft.

Figure 4:
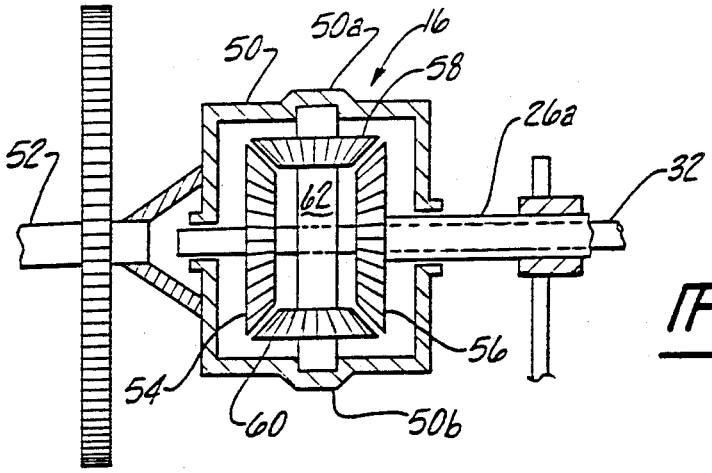
FIG. 4 is a cross-sectional view of the converter means shown in the engine of FIG. 1.

Converter mechanism 16, as best seen in FIG. 4, includes a housing 50, an output shaft 52 fixedly and centrally secured to housing 50, and a plurality of pinion bevel gears 54, 56, 58 and 60 positioned within housing 50. Pinion gear 54 is drivingly secured to shaft 32; pinion gear 56 is drivingly secured to shaft portion 26*a;* and pinion gears 58 and 60 are meshingly engaged with gears 54 and 56 and secured in axially spaced relation on a pinion shaft 62 which in turn is journalled at its upper and lower ends in journal portions 50*a* and 50*b* of housing 50.

The engine further includes a supercharger 64 including a blower 66 drivingly connected to output shaft 52 of converter mechanism 16 by reduction gears 68, 70, 72 and 74. A suitable conduit 76 interconnects the output of supercharger 64 with the intake port 22 of housing 10.

OPERATION

Figure 2:
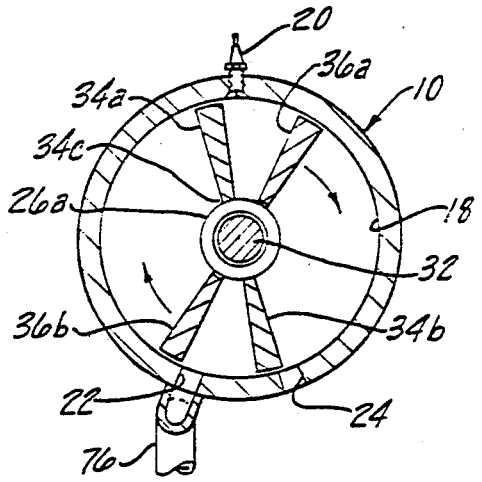
FIG. 2 is a transverse cross-sectional view taken on lines 2—2 of FIG. 1.
Figure 3:
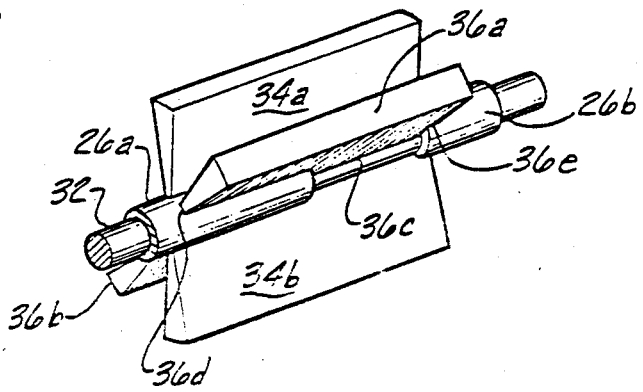
FIG. 3 is perspective view of the piston vane assembly used in the engine of FIG. 1.

To start the engine, an electric motor 77 engages gear 52 to rotate output shaft 52 to impart initial rotation to pistons 34, 36. In order to impart differential rotation as well as absolute rotation to the pistons, supercharger 64 operates to supply a fuel mixture charge to the intake 22 under boost pressure. This charge begins the compression and expansion strokes of the engine. Instead of a supercharger, a turbocharger or other suitable means for supplying a charge under boost pressure may be employed. For the sake of simplicity, a carburetor or other fuel mixing device is not shown in the drawings. The movement of the pistons 34, 36 through the various phases of the engine operation is best seen in FIG. 2. With the pistons 34 and 36 in the position seen in FIG. 2, the sparkplug 20 is energized to ignite the fuel mixture confined by piston portions 34*a* and 36*a*. As the fuel burns and expands, it acts against piston portion 36*a* to force piston 36 to rotate in a clockwise direction. The piston 34 is prevented from counterclockwise rotation by ratchet mechanism 38. Alternatively, a unidirectional clutch, hydraulic system with check valves, or other control means might be used. As piston portion 36*a* approaches piston portion 34*b*, burned combustion products from the previous ignition are expelled through exhaust port 24. At the same time, a new fuel air mixture is drawn in through intake port 22 as piston charge confined in the area between piston 36*b* and piston portion 34*a* is compressed. As piston portion 36*b* moves close to piston portion 34*a*, the build-up of pressure in the space between the two piston portions forces piston portion 34*a* to move past sparkplug 20 and a new charge is ready for firing to complete the cycle.

Just before the sparkplug ignites the new charge, both pistons 34 and 36 are moving in a clockwise direction. After the firing, the relative rates at which piston 34 decelerates and piston 36 accelerates can be determined by the following analysis:

Let:

F equal the clockwise force on a pair of pistons

A equal the area on one side of a piston

T equal time

S equal $p_{36a\text{-}34a}$ equal pressure between vane portions 36a and 34a

$p_{34a\text{-}36b}$ equal pressure between vane portions 34a and 36b

$p_{36b\text{-}34b}$ equal pressure between vane portions 36b and 34b

$p_{34b\text{-}36a}$ equal pressure between vane portions 34b and 36a

Then:

1. $F_{34}=-AP_{36a\text{-}34a}+AP_{34a\text{-}36b}-AP_{36b\text{-}34b}+AP_{34b\text{-}36a}$
2. $F_{36}=AP_{36a\text{-}34a}-AP_{34b\text{-}36a}-AP_{34a\text{-}36b}+AP_{36b\text{-}34b}$
3. $F_{34}=-F_{36}$ Assuming the mass of the concentric shafts are the same and the two pistons are equal in size, from F =mass x acceleration =mass x S 4. $\Delta S_{34}=-\Delta S_{36}$ or $\Delta S_{26}=-\Delta S_{32}$ From the geometry of a differential gear coupling 5. $\frac{1}{2}S_{26}+\frac{1}{2}S_{32}=S_{52}$ where $S_{26}$, $S_{32}$ and $S_{52}$ are the respective speeds of concentric shaft 26, concentric shaft 32, and output shaft 52.

After a lapse of time equal to $\Delta$ T:

6. $\frac{1}{2}(S_{26}+\Delta S_{26})+\frac{1}{2}(S_{32}+\Delta S_{32})=S_{52}+\Delta S_{52}$ or
7. $\frac{1}{2}\Delta S_{26}+\frac{1}{2}\Delta S_{32}=\Delta S_{52}$ by substituting equation 4. in equation 7.

8. $\Delta S_{52}=0$

Thus, for a given engine throttle setting, the output speed of the drive shaft 52 is constant a the pistons 34 and 36 alternately accelerate and decelerate during the engine cycle. When a particular piston is held stationary by its ratchet mechanism, the speed of the drive shaft 52 equals $\frac{1}{2}$ of the speed of the other or moving piston.

Supercharger 64, in addition to imparting relative rotation to the vanes in order to facilitate starting of the engine, also functions during steady state operation of the engine to increase the charge delivered to the engine and thereby optimize engine power. Supercharger 64 also functions during idling conditions to preclude stalling of the engine. Unlike reciprocating engines, as well as rotary engines with programmed movements, the rotary engine of the invention permits the vanes to rotate freely and therefor has no fixed displacement. When the engine is throttled back to an idle mode, the vanes, in the absence of supercharger 64, would continue to rotate but would not undergo relative rotation so that no fuel charge would be sucked into the engine and the engine would soon stall. Supercharger 64 functions under idling conditions to deliver a charge under boost pressure between the vanes to keep the engine from stalling.

Figure 6:
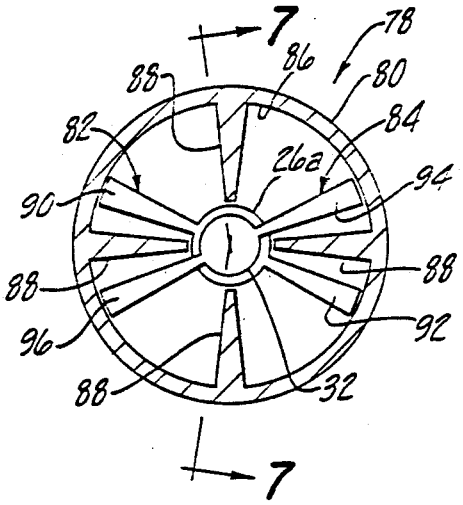
FIG. 6 is view of an alternate form of converter means for use in the engine of FIG. 1.
Figure 7:
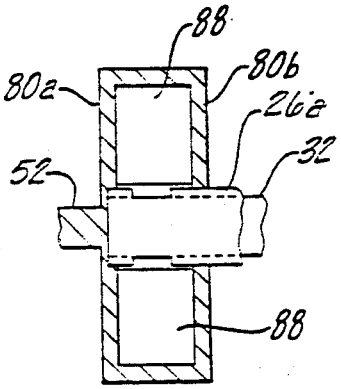
FIG. 7 is a cross-sectional view taken on line 7—7 of FIG. 6.

Although a differential gear assembly is eminently satisfactory for use with the invention rotary internal combustion engine, other converter mechanisms may be used. For example, as seen in FIGS. 6 and 7, a pneumatic coupling 78 may be used as the converter mechanism.

Coupling 78 includes a housing 80 and vanes 82 and 84. Housing 80 is generally circular and defines a central chamber 86 within which vanes 82 and 84 are disposed. Output shaft 52 is defined centrally and integrally with one side wall 80a of the housing and four internal vanes 88 are provided integral with the housing and projecting radially inwardly from the outer shell of the housing. Shafts 32 and 26a are suitably journalled in side walls 80a and 80b of the housing. Vane 82 includes vane portions 90 and 92 secured to shaft 26a in a manner similar to the securement of piston 34 to shaft 26a. Vane 84 includes vane portions 94 and 96 secured to shaft 32 in a manner similar to the securement of piston 36 to shaft 32. A compressible gas is contained within the housing. Housing vanes 88 will move so as to remain equidistant between vanes 82 and 84. This behavior assumes that the vanes fit airtight and that the inertia in the output shaft can be ignored. The above relationship can be expressed mathematically as follows:

Let $\theta$ equal the location of a vane.

Then:

1. $\theta_{94}-\theta_{88}=\theta_{88}\theta_{90}$

After a time lapse of T, vane 94 will be at $\theta_{94}+\Delta\theta_{94}$; vane 90 will be at $\theta_{90}+\Delta\theta_{90}$; and housing vane 88 will be at $\theta_{88}+\Delta\theta_{88}$ so that:

2. $\theta_{94}+\Delta\theta_{94}-\theta_{88}-\Delta\theta_{88}=\theta_{88}+\Delta\theta_{88}-\theta_{90}-\Delta\theta_{90}$ By combining equations 1 and 2:

3. $\Delta\theta_{94}-\Delta\theta_{88}=\Delta\theta_{88}-\Delta\theta_{90}$ or
4. $\Delta\theta_{94}+\Delta\theta_{90}=2\Delta\theta_{88}$ Dividing equation 4 by 2 $\Delta$ T, the following expression is obtained:

5. $\frac{1}{2}S_{94}+\frac{1}{2}S_{90}=S_{88}$

This equation will be recognized as the same as the equation describing the motion of the differential gear coupling 16. Thus, for the purposes of this invention, the differential gear coupling 16 and the pneumatic coupling 78 perform identically and may be used interchangeably.

Figure 8:
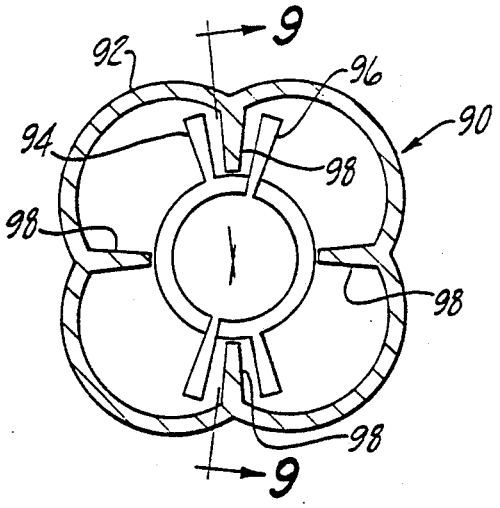
FIG. 8 is a view of another alternate form of converter means for use in the engine of FIG. 1.
Figure 9:
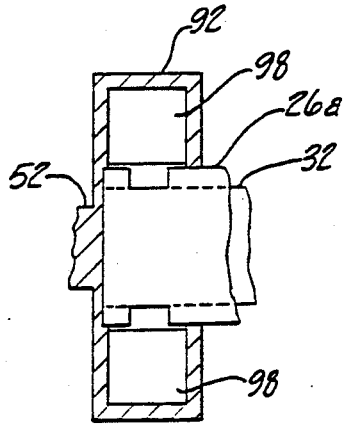
FIG. 9 is a cross-sectional view taken on line 9—9 of FIG. 8.

Other types of converter mechanisms may also be employed. Thus, referring to FIGS. 8 and 9, a hydraulic coupling 90 may also be employed as the converter mechanism. Coupling 90 includes a housing 92 and a pair of vanes 94 and 96. Housing 90 has a multi-lobe configuration in cross section and includes a series of circumferentially spaced internal vanes 98 extending radially inwardly from the outer shell of the housing. Vanes 94 and 96 are secured to shafts 26a and 32 in the same manner described previously with reference to the securement of vanes 34 and 36 to shafts 26a and 32.

The lobed configuration of the casing has the effect of reducing fluid friction while still preventing the moving vanes 94 and 96 from colliding with the housing vanes 98.

Figure 10:
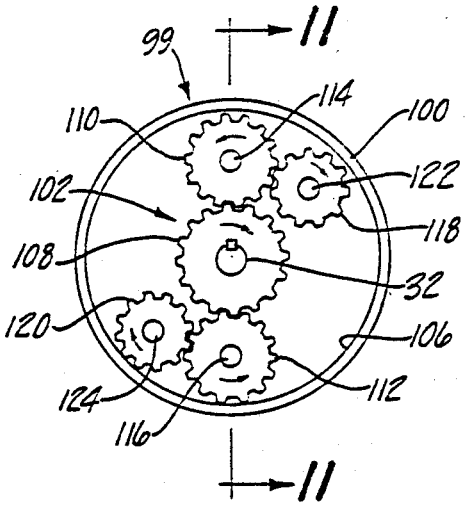
FIG. 10 is a view of a still further alternate converter means for use in the engine of FIG. 1.
Figure 11:
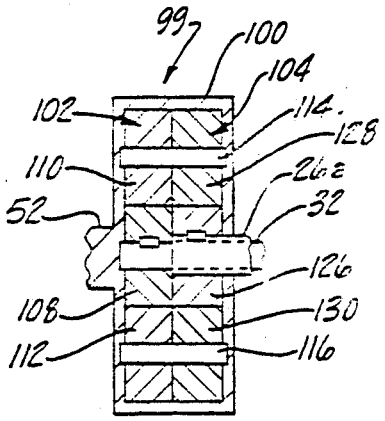
FIG. 11 is a cross-sectional view taken on line 11—11 of FIG. 10.

A further form of converter mechanism is seen in FIGS. 10 and 11. The converter mechanism of FIGS. 10 and 11 comprises a hydraulic differential coupling 99. Coupling 99 includes a housing 100; a first gear set 102; and a second gear set 104.

Housing 100 is generally cylindrical and defines an inner chamber 106 within which gear sets 102 and 104 are disposed.

Gear set 102 is associated with shaft 32 and includes a sun gear 108 keyed to shaft 32; a pair of planetary gears 110 and 112 meshingly engaging with diametrically opposed portions of sun gear 108 and journalled in chamber 106 by shafts 114 and 116: and a further pair of planetary gears 118,120 meshingly engaging respectively with planetary gears 110 and 112 and journalled in chamber 106 by shafts 122 and 124.

Similarly, gear set 104 includes a sun gear 126 keyed to shaft 26*a*; a pair of planetary gears 128 and 130 meshing with diametrically opposed portions of sun gear 126 and journalled in chamber 106 on shafts 114 and 116; and a further pair of planetary gears (not shown) meshingly engaging respectively with planetary gears 128 and 130 and carried on shafts 122 and 124, respectively. The four planetary gears that are associated with each sun gear rotate tangentially to the inner wall of the housing 100 and they therefore act as a gear pump. Because these gears oppose each other, they are kept from rotating about their axes unless fluid is withdrawn. Under these conditions, where fluid is neither added or removed, the entire housing will rotate with the sun gear.

The principle on which the coupling of FIGS. 10 and 11 operates is that the combined fluid flow from the two gear trains or pumps must be balanced by the fluid flow due to the rotation of the housing 100 which is connected to the output shaft 52. This relationship leads to the following expressions:

Let:

Q equal flow rate

S equal speed of the shaft

C equal capacity of gear pump

Then

1. $Q_{102}+Q_{104}=Q_{100}$
   And because $Q = SC$
2. $S_{102}C_{102}+S_{104}C_{104}=S_{100}C_{100}$
   Since $C_{102}=C_{104}=\frac{1}{2}C_{100}$
3. $\frac{1}{2}S_{102}+\frac{1}{2}S_{104}=S_{100}$ This equation will be recognized as the same equation as that which describes the motion of the differential gear coupling 16. Thus, for the purposes of this invention hydraulic differential coupling 99 is equivalent to and may be used interchangeably with the differential coupling 16.

In addition to the three forms of converter mechanism disclosed, other forms may be used. For example, a spring or magnetically loaded coupling might be used as the converter mechanism.

With particular reference to FIG. 2, the location of the intake and exhaust ports can be determined by making certain assumptions. For example, a compression ratio of 8 to 1 can be specified. This ratio can be realized by allowing the closest proximity of the pistons to be 20' and the maximum spacing between the pistons to be 160'. Further, by assuming that the build-up of the pressure of the products of combustion is instantaneous and that the pistons have negligible momentum, the exhaust port should be located 20' off of the center line. Similar reasoning may be applied to dictate the location of the intake port.

The engine design need not be limited to one intake or one exhaust port. In fact, the invention engine ideally lends itself to the use of a stratified charge, thus reducing air pollution without sacrificing performance. For example, one intake port could supply an enriched fuel mixture while a second intake port could introduce a lean mixture.

FIG. 2 also helps to illustrate a key feature of the invention whereby the pistons are free to move independently of each other. Because the pistons are free moving, they are able to automatically compensate or adjust to changes in operating conditions. For example, the point at which the abutment piston 34*a* comes to rest will depend upon such operating variables as the speed of the engine, its load, the ambient temperature, and the fuel composition. Thus, preignition or knocking, as experienced in reciprocating engines using low octane gasoline, should have a minimum effect on the invention engine. Also, since the pistons are free moving, a major source of vibration, wear and inefficiency is eliminated. This feature also allows the invention engine to operate at much higher speeds as compared to other rotary engines or other engines of the reciprocating variety.

Further modifications of the basic design of the invention engine are possible. For example, fuel injection may be used in place of a carburetor; and rather than employing a sparkplug to ignite the fuel mixture, a diesel configuration may be used. Also, more than one combustion chamber may be used to provide additional power.

The advantages of the invention engine are numerous. Perhaps the most dramatic advantage as compared to conventional internal combustion engines is the extremely high power output per engine weight. Another striking feature is the engine's simplicity, which permits substantial savings in manufacture and maintenance. Because all moving parts are symmetrical, vibration is kept to a minimum, thus reducing noise, wear and inefficiencies. Fuel consumption also is thereby reduced. The engine's relatively high torque offers potential advantages in simplifying transmissions. Additional benefits also flow from the engine's small size and low profile which present many design advantages, particularly where streamlining is critical. The provision of means to deliver a charge under boost pressure is also extremely beneficial since it facilitates starting of the engine by providing relative rotation between the vanes optimizes engine power under steady state operation by increasing the charge delivered to the engine; and precludes stalling of the engine under idling conditions by ensuring that a charge is delivered under pressure between the vanes. The invention engine has many practical applications. For example, the invention engine could serve as a replacement for the standard reciprocating automobile engine; the invention engine could find applications in aviation where high power to weight is critical and good fuel economy is required; and the invention engine could be used in lawn mowers and motorcycles where its small size, light weight and simplicity offer important advantages. Numerous military applications can also be imagined.

Whereas preferred embodiments of the invention have been illustrated and described in detail, it will be apparent that various changes may be made in the disclosed embodiments without departing from the scope or spirit of the invention.

I claim:

1. An internal combustion engine comprising:

(A) a housing defining a combustion chamber having an intake port;

(B) a first vane mounted for rotation in said combustion chamber about a fixed axis;

(C) a second vane mounted for rotation in said combustion chamber about said fixed axis independently of said first vane;

(D) control means preventing rotation of either vane in one direction about said axis while allowing free rotation in the other direction about said axis so that said vanes may rotate freely in said other direction about said axis and may simultaneously undergo relative rotation;

(E) converter means, including an output shaft, drivingly connected to said vanes and operative to convert such rotation of said vanes in said other direction and such relative rotation into unidirectional rotation of said output shaft in said other direction; and (F) starter means for said engine including means for generating relative rotation of said vanes by delivering a charge to said intake port under a boost pressure.

2. An internal combustion engine according to claim 1 wherein:

(G) said starter means includes means for rotating said output shaft in said other direction to rotate each of said vanes in said other direction and means for simultaneously delivering a charge under boost pressure between said rotating vanes through said intake port.

3. An internal combustion engine according to claim 2 wherein:

(H) said means for delivering a charge under boost pressure comprises a supercharger drivingly connected to said output shaft and having its fluid outlet in fluid communication with said intake port.

4. An internal combustion engine according to claim 2 wherein:

(H) a pair of concentric driveshafts are positioned on said axis and respectively drivingly secured to said first vane and said second vane, and said shafts extend axially out of one side of said combustion chamber for connection to said control means and extend axially out of the other side of said combustion chamber for connection to said converter means.

5. An internal combustion engine according to claim 2 wherein:

(H) said control means comprises a pair of ratchet mechanisms engageable, respectively, with said first vane and said second vane.

6. An internal combustion engine according to claim 2 wherein:

(H) said converter means comprises a differential gear assembly including a first pinion gear drivingly connected to said first vane, a second pinion gear drivingly connected to said second vane, a converter means housing secured to said output shaft, and further pinion gears drivingly connected with said first and second pinion gears and carried on a pinion shaft journalled in said converter means housing.

7. An internal combustion engine according to claim 2 wherein:

(H) said converter means comprises a pneumatic coupling including a converter means housing secured to said output shaft and defining a generally cylindrical chamber, first and second converter vanes mounted for independent rotation in said converter means housing and respectively drivingly connected to said first and second vanes of said combustion chamber, and a plurality of rigid internal vanes extending radially inwardly from said converter means housing at circumferentially spaced locations thereabout and coacting with said converter vanes to drive said converter means housing and thereby said output shaft.

8. An internal combustion engine according to claim 2 wherein:

(H) said converter means comprises a hydraulic coupling including a converter means housing secured to said output shaft, a pair of converter vanes respectively drivingly connected to said first and second vanes in said combustion chamber, and a plurality of internal vanes rigid with said converter means housing and extending radially inwardly from said converter means housing at circumferentially spaced locations thereabout and coacting with said converter vanes to drive said converter means housing and thereby said output shaft.

9. An internal combustion engine according to claim 2 wherein:

(H) said converter means comprises a hydraulic differential coupling including a converter means housing secured to said output shaft and defining a generally cylindrical converter means chamber, and a pair of planetary gear sets disposed in side by side relation within said converter means chamber and each including a sun gear respectively drivingly connected to one of said first and second vanes in said combustion chamber, each of said planetary gear sets further including a pair of planet gears meshingly engaging with diametrically opposed portions of the respective sun gear and disposed generally tangentially with respect to the inner periphery of said converter means chamber and a second pair of planet gears respectively meshingly engaged with the first pair of planet gears and tangentially disposed with respect to the internal periphery of said converter means chamber.

10. A method of starting a rotary engine of the type including two vanes mounted for rotation in a combustion chamber about a common central axis, said method comprising:

(A) mounting said vanes for independent rotation in said chamber about said axis;

(B) connecting said vanes to concentric independent shafts mounted on said axis;

(C) providing means precluding rotation of each of said vanes and its associated shaft in one direction about said axis but allowing free rotation of each of said vanes and its associated shaft in the opposite direction about said axis;

(D) connecting said shaft to an output drive member through a differential mechanism allowing relative rotation between said shafts;

(E) rotating said output drive member to of said vanes in said one direction; and (F) introducing boost pressure between said vanes to urge rotation of one of said vanes in said one direction and resist rotation of the other of said vanes in said one direction to thereby provide relative rotation of said vanes, accommodated by said differential mechanism, to facilitate starting of the engine.

11. A method according to claim 10, wherein said chamber has an intake port; and (H) said boost pressure is introduced between said vanes by providing a supercharger driven by said output shaft and delivering the output of said supercharger to said chamber intake port.

* * * * *

UNITED STATES PATENT AND TRADEMARK OFFICE

CERTIFICATE OF CORRECTION

PATENT NO. : 4,890,591

DATED : January 2, 1990

INVENTOR(S) : Stauffer

It is certified that error appears in the above-identified patent and that said Letters Patent is hereby corrected as shown below:

Column 2, line 61, after "is" insert --a--";

Column 3, line 23, after "housing" insert --10.--;

Column 3, line 42, after "36a" insert --and--;

Column 3, line 65, "seem" should be "seen";

Column 4, line 60, after "piston" insert --portion 36b separates from piston portion 34b, and the--;

Column 5, line 8, after "equal" insert --speed--;

Column 5, line 36, "a" should be --as--;

Column 6, line 18, "$\Theta_{88}\Theta_{90}$" should be --$\Theta_{88}$-$\Theta_{90}$--;

Column 6, line 19, after "of" insert --$\Delta$--;

Column 10, line 51, after "to" insert --rotate each--.

Signed and Sealed this

Fifth Day of March, 1991

*Attest:*

HARRY F. MANBECK, JR.

*Attesting Officer*

*Commissioner of Patents and Trademarks*